US005201556A

United States Patent [19]

Kendall

[11] Patent Number: 5,201,556

[45] Date of Patent: Apr. 13, 1993

[54] AMMUNITION COMPARTMENT BLAST DOOR LOCK

[75] Inventor: Donald H. Kendall, Almont, Mich.

[73] Assignee: The United States of America as represented by the Secretary of the Army, Washington, D.C.

[21] Appl. No.: 891,249

[22] Filed: Jun. 1, 1992

Related U.S. Application Data

[63] Continuation-in-part of Ser. No. 845,282, Mar. 3, 1992, abandoned.

[51] Int. Cl.[5] ..... E05C 9/20

[52] U.S. Cl. ..... 292/257; 89/34; 89/36.13; 49/31; 292/DIG. 7; 292/DIG. 65; 292/45

[58] Field of Search ..... 89/34, 36.13; 49/31; 292/257, 341.13, 341.17, DIG. 65, DIG. 7, 45

[56] References Cited

U.S. PATENT DOCUMENTS

| | | | |
|---|---|---|---|
| 1,576,417 | 3/1926 | Druzbalk | 292/257 |
| 1,766,332 | 6/1930 | Fister | 292/DIG. 7 |
| 1,804,877 | 5/1931 | Johnson et al. | 292/DIG. 7 |
| 4,304,429 | 12/1981 | Gist | 292/DIG. 7 |
| 4,690,031 | 9/1987 | Metz et al. | 89/36.13 |
| 4,714,282 | 12/1987 | Henderson | 292/DIG. 65 |
| 4,807,914 | 2/1989 | Fleming et al. | 292/DIG. 7 |
| 4,836,085 | 6/1989 | Winkler et al. | 89/36.13 |
| 4,864,913 | 9/1989 | Grünewald et al. | 89/34 |
| 4,928,574 | 5/1990 | Golden | 89/34 |

FOREIGN PATENT DOCUMENTS

| | | | |
|---|---|---|---|
| 3106039 | 1/1982 | Fed. Rep. of Germany | 292/DIG. 7 |

*Primary Examiner*—Richard E. Moore

*Attorney, Agent, or Firm*—Peter A. Taucher; David L. Kuhn

[57] ABSTRACT

Disclosed is a locking mechanism to retain and seal a blast door of an ammunition compartment against a compartment door frame after an explosion in the compartment. The mechanism has a linkage connected to a panel that is blown off the compartment by the explosion, whereby the panel actuates the mechanism. The linkage turns a cam a controlled amount so that the cam contacts the door in an optimal position for retaining and sealing the door.

15 Claims, 3 Drawing Sheets

AMMUNITION COMPARTMENT BLAST DOOR LOCK

GOVERNMENT USE

The invention described herein may be manufactured, used and licensed by or for the U.S. Government for governmental purposes without payment to me of any royalty.

RELATED APPLICATION

This patent application is a continuation in part of a prior application: Ser. No. 07/845,282 filed Mar. 3, 1992 and having Atty Docket No. TA-2693, now abandoned. The inventor and title of the invention are the same in this and the prior application.

BACKGROUND

Military vehicles often have specially designed ammunition compartments that limit vehicle damage and crew casualties if the compartment is hit by enemy fire. For example, the turret bustle of the U.S. Army's M1 Abrams tank has such an ammunition compartment. Strong, heavily reinforced blast doors separate the compartment from the rest of the turret and the compartment has a panel designed to blow off to vent an explosion. The blast doors are able to resist the vented explosion force and therefore shield the crew and the remainder of the vehicle.

However, at least two problems remain with known blast door designs. First, the force of the explosion, even though vented, bows the doors in toward the crew compartment. The doors then rebound, bowing back into the ammunition compartment, thereby unsealing the doors from the door frame. The unsealing allows flames and gas from the explosion to enter the crew area of the turret, possibly harming the soldiers there. Second, a post explosion danger exists if the blast doors insufficiently seal against chemical or biological antipersonnel agents, which may surround the tank in a foreseeable battle scene.

SUMMARY OF THE INVENTION

My invention is a locking mechanism that keeps blast door sealingly pressed against an ammunition compartment door frame after an explosion in the compartment. The locking mechanism has a mechanical linkage connected to the blow off panel so that the separation of this panel from the compartment actuates a camming device that presses the blast doors against the compartment frame. The camming device includes generally ovoid cams having cam zones which interferingly and frictionally jam the doors against the frame once the cams rotate into contact with the doors, whereby the doors are sealingly locked against the frame. The friction between the doors and the frames, as well as the interference between the cam zones the doors, prevent the doors from moving thereafter. The linkage is designed to break before it damages the camming device. The locking mechanism also has means to prevent excess rotation of the camming device so that the device maintains an optimal door sealing position after an explosion, thereby maximizing the tank crew's protection from battlefield antipersonnel agents or harmful airborne contaminants.

DETAILED DESCRIPTION

Figure 1:
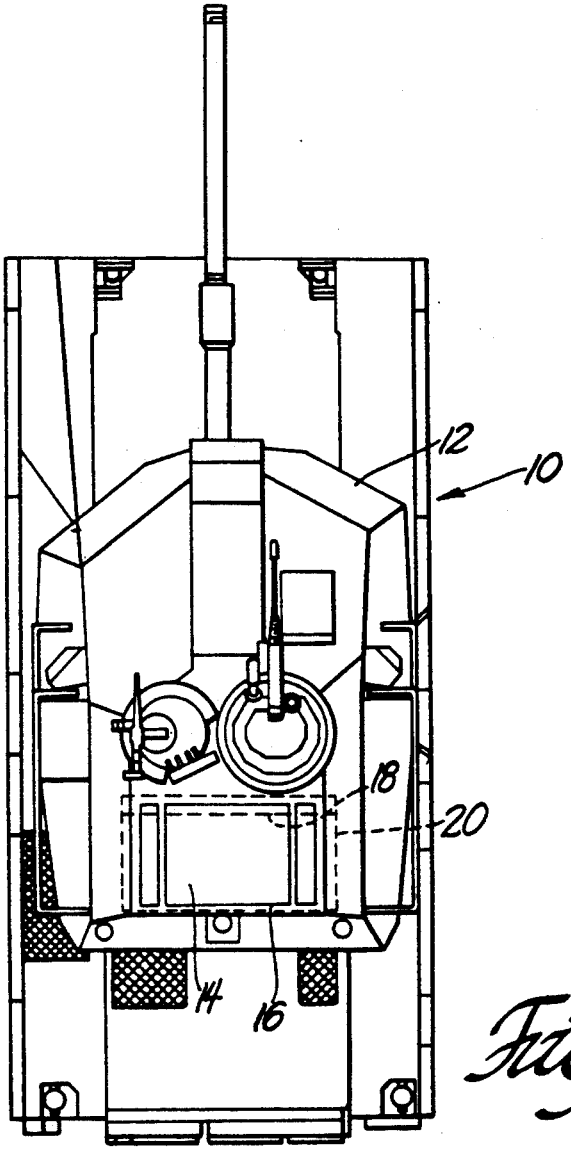
FIG. 1 is a plan view of a tank showing the location of an ammunition compartment in the turret.

FIG. 1 is a plan view of the U.S. Army's M1A1 Abrams Tank 10 having turret 12 mounted thereon. In the rear of the turret is bustle zone 14 where a closed ammunition compartment 20 is located, the top of the ammunition compartment being formed by blow off panel 16. Panel 16 is designed to break away should an explosion occur in the ammunition compartment. The force of any explosion will be directed upward, whereby the tank crew members in the turret will survive and the tank may be operable enough to carry the crew from the battle zone. Blast door assembly 18, by which the crew accesses ammunition in compartment 20, is schematically designated by shed elongate rectangle 18 in FIG. 1.

Figure 2:
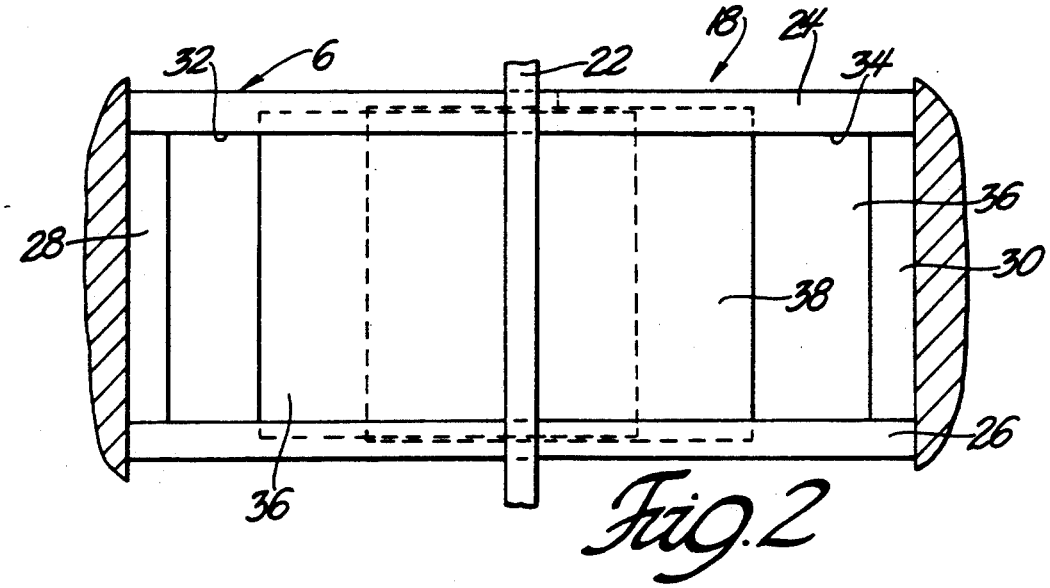
FIG. 2 is a front elevational view of the door frame and blast doors of the tank's ammunition compartment.

FIG. 2 is a view of the blast door assembly as it would be seen by a crew member in the turret. Many known conventional details of assembly 18 are not part of the present invention and omitted for convenience, such details including seals, door tracks, latches, hand holds and a hydraulic actuator. The door frame 6 of the blast door assembly includes a frontal rib 22 running from the top to the bottom of the turret. The frame further includes an upper horizontal beam or header 24 having a door guide rail (not shown), the header forming the top of a frame for assembly 18. A lower horizontal beam or sill 26, which typically has a lower door guide rail (not shown), forms the bottom of the frame for assembly 18. Vertical beams or jambs 28 and 30 form the sides of the frame for the assembly.

Frame 6 defines door opening at 32 normally closed by sliding blast door 36 and a second door opening 34 normally closed by sliding blast door 38. The doors when closed have their peripheral edges faced toward the obverse vertical surface of the frame as seen in FIG. 2. Typically there are seals 41 and 43 (FIG. 3) of felt or other material between the peripheral edge of the doors and the frame.

Figure 3:
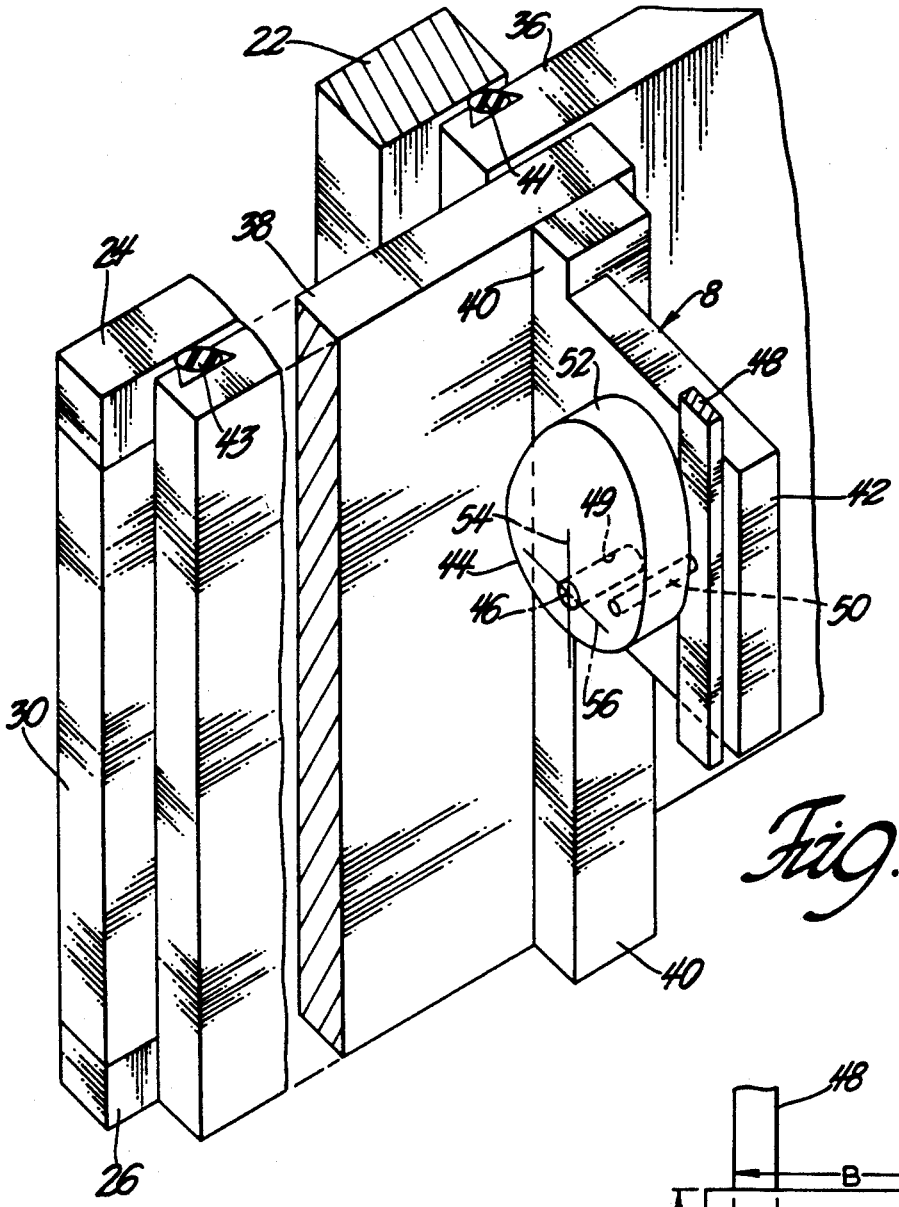
FIG. 3 is a partial perspective view of my locking mechanism as installed at an inside blast door surface.
Figure 7:
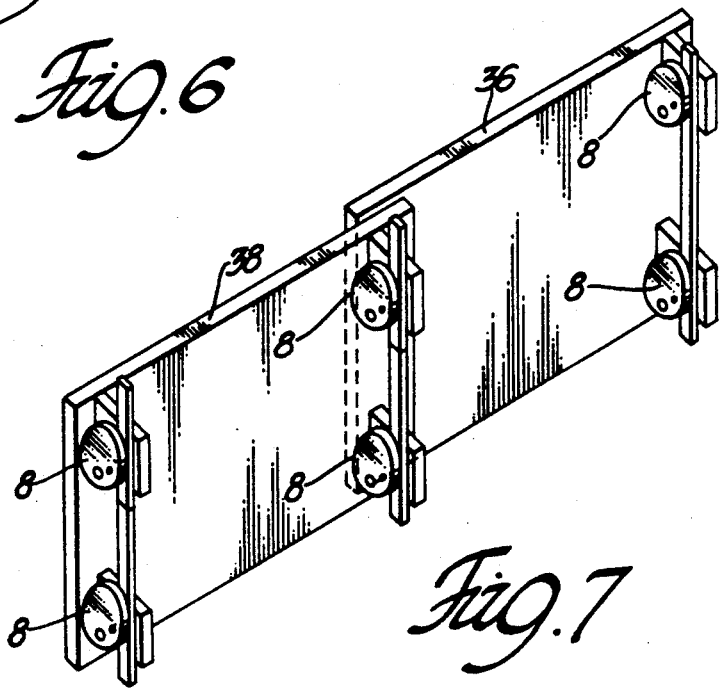
FIG. 7 is a perspective view of the doors as seen from inside the ammunition compartment, the doors having a plurality of locking mechanisms installed thereon.

FIG. 3 is a partial perspective view of blast doors and lock assembly 8 as seen from inside the ammunition compartment. The lock assembly is disposed on the inner side of door 38, which forms part of the inner peripheral surface of ammunition compartment 20. A second, identical lock assembly would be located along the right edge of door 38 in the figure, but is omitted from FIG. 3 for convenience. The positions of a second lock assembly 8 and additional lock assemblies relative to the blast doors are shown in FIG. 7.

Figure 6:
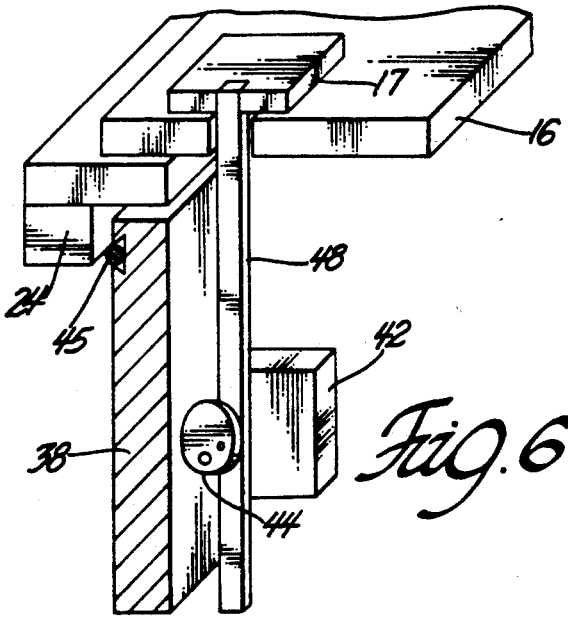
FIG. 6 is a perspective view showing the connection between the locking mechanism and the blow off panel.

Lock assembly 8 includes upright inner brace 40 having a vertical plate-like extension 42. Pivotally mounted to extension 42 by axis pin 49 is cam 44, the cam pivotable about axis 46. Cam 44 typically has a generally ovoid or elliptical shape, and has a major diameter 54 (FIG. 4) of dimension "A" perpendicular to and greater than minor diameter 56 of dimension "B". Cam 44 has a somewhat lobed door engaging edge zone 52 disposed at one end of major diameter 54. A vertically translatable linkage member or rod 48 is connected via shear pin 50 to cam 44 near the peripheral edge of the cam, the shear pin being sixty to one hundred twenty degrees away from edge zone 52. The upper end of rod 48 is fastened to blow off panel 16 as shown in FIG. 6, wherein plate 17 is welded to both rod 48 and panel 16. Rod 48 may optionally be replaced by a cable.

When blow off panel 16 is lifted off turret 12 up by the force of an explosion in ammunition compartment 20, rod 48 translates upward, thereby rotating cam 44 counterclockwise in FIG. 3 until edge zone 52 bears against blast door 38. Door 38 is forced and then held forward so that seals 41 and 43 are tightly squeezed between the doors and the frame, thereby forming an effective seal against biological or chemical antipersonnel agents outside the turret. Edge zone 52 is in frictional, slightly interfering contact with door 38 so that friction between door 38 and rib 22 prevents door 38 from rotating cam 44 from its door locking position. Once zone 52 bears against door 38, the force needed to turn cam 44 further is sufficient to break shear pin 50 but not to damage cam 44, pin 49 or extension 42.

It is preferred that shear pin 52 be between sixty and one hundred twenty degrees from zone 52. It is further preferred that shear pin 50 rotate to a position near the top of the cam, between the ten twelve o'clock position, when zone 52 bears against door 38. Rod 48 will then exert mainly radial and relatively little rotational force on cam 44, whereby the upward pull of rod 48 will not rotate zone 52 out of contact with door 38. All of the pulling force from the rod will be used to break shear pin 50 and subsequently allow rod 48 to continue its upward travel.

Figure 4:
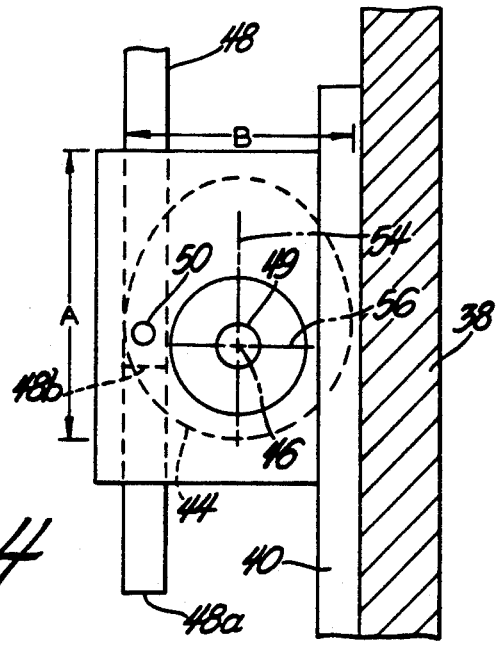
FIG. 4 is a side elevational view of the locking mechanism.

A second view of lock assembly 8 is seen in FIG. 4, this view being from a vantage point on the side of extension 42 that is hidden in FIG. 3. In this view, cam 44 rotates clockwise when blow off panel 16 pulls rod 48 upward. When rod 48 travels upward it also shifts rightward in FIG. 4 and will contact axis pin 49 after cam 44 rotates between 60 and 90 degrees. The contact between pin 49 and rod 48 prevents further rotation of cam 44. This contact prevents cam 44 from rotating too far, such that zone 52 rotates past its optimum position of contact with the portion of door 38 which cam 44 is intended to engage. To insure that the aforementioned contact between rod 48 and pin 49 occurs, it is preferred that the portion of rod 48 below shear pin 50 be at least one-half the length "B" of the cam's minor diameter. The lower end of rod 48 can be at 48*a*, for example, in FIG. 4.

It may in some applications be preferable to shorten rod 48 so that its lower end is at 48*b*. In this case, rod 48 stays clear of pin 49 upon clockwise rotation of cam 44 in FIG. 4, so that shear pin 50 will arrive at the twelve o'clock position. Since the pull of panel 16 on rod 48 is then parallel to a radius of the cam, rod 48 will exert no rotational force on cam 44. In fact, the force of rod 48 will resist further rotation clockwise of cam 44 so that zone 52 will not travel out of contact with door 38.

Figure 5:
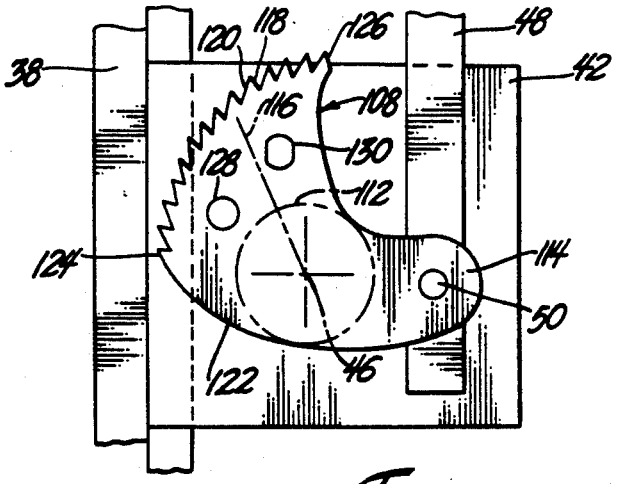
FIG. 5 is a side elevational view of an alternate embodiment of the locking mechanism.

FIG. 5 shows an alternate structure for the cam. Cam 108 is pivotally connected to extension 42 in any conventional fashion or by the same fashion as cam 44 in FIG. 3. Cam 108 may be spaced from extension 42 by disk bushing 112. Cam ear 114 is connected to rod 48 by means of shear pin 50 so that vertical translation of rod 48 rotates cam 108. Toothed sector 122 has an arcuate array of teeth, the array beginning 70 to 110 degrees counterclockwise from shear pin 50 and ending 120 to 180 degrees clockwise from the shear pin. The distance of the teeth from axis 46 gradually increases from end 124 of the array more distal from the shear pin to end 126 more proximal to the shear pin. Teeth nearer end 126 than end 124 will interferingly engage door 38 when cam 108 is rotated counterclockwise.

Each tooth has a distal side 120, a proximal side 118 and a radius 116. The radius extends from axis 46 to the intersection of the proximal and distal tooth sides. The acute angle between proximal side 118 and radius 116 is smaller than the acute angle between distal side 120 and radius 116, whereby the teeth are slanted in the clockwise angular direction. The slant of the teeth inhibits clockwise rotation of cam 108 once teeth nearer end 126 interferingly engage door 38 to lock cam 108 thereagainst.

It is contemplated that radius 116 will have moved from its FIG. 5 position (between the 12 o'clock and 9 o'clock position in the figure) closer to the horizontal, 9 o'clock position when cam is lockingly forcing door 38 leftward in the figure. Further counterclockwise movement of cam 108 is inhibited by the continuous enlargement of radius 116 for teeth increasingly nearer to proximal end 126. Consequently, cam 108 tends to remain in a door locking position once the cam has reached that position.

Optionally, cam 108 may be provided with holes 128 and 130 in cam sector 122 so as to increase the radial flexibility of the cam sector. When cam 108 turns counterclockwise in FIG. 5 position, the teeth of sector 122 engage wall 38, and holes 128 and 130 collapse to permit cam sector 122 to be compressed radially. The radial compressibility of cam sector 122 reduces amount of rotational force needed to lockingly jam the sector between axis 46 and wall 38. This insures that neither ear 114 nor shear pin 50 will fail before cam 108 effectively locks against door 38.

I wish it understood that I intend not to be limited to the exact details of construction shown and described herein since obvious modifications will occur to those skilled in the relevant arts without departing from the spirit and scope of the following claims.

I claim:

1. A locking mechanism for the door of a compartment, the locking mechanism actuated by motion of a compartment panel, the locking mechanism comprising:

a frame member fixed relative to the compartment;

a pivotable member remote from the panel;

a door engagement zone on the pivotable member;

means for mounting the pivotable member rotatably to the frame member;

linkage means for rotating the pivotable member in response to motion of the panel, the linkage means connected between the pivotable member and the panel.

2. A locking mechanism for the door of a compartment, the locking mechanism actuated by motion of a compartment panel, the locking mechanism comprising:

a frame member fixed relative to the compartment;

a pivotable member;

a door engagement zone on the pivotable member;

means for mounting the pivotable member rotatably to the frame member;

linkage means for rotating the pivotable member in response to motion of the panel;

wherein the linkage means interferingly engages the mounting means after predetermined rotation of the pivotable member.

3. The mechanism of claim 2 wherein:

the pivotable member is a cam;

the mounting means comprises an axis pin on the frame member, the cam rotatable on the axis pin;

the linkage means comprises a rigid linkage member, wherein a portion of the linkage member faces toward the axis pin;

the linkage member has a first position in which the portion is removed from the axis pin;

the linkage member has a second position in which the portion contacts the axis pin.

4. The mechanism of claim 3 including a shear pin connecting the cam to the linkage member, the shear pin breaking after the door engagement zone contacts the door.

5. The mechanism of claim 4 wherein the linkage member is in the second position when the door engagement zone contacts the door.

6. The mechanism of claim 4 wherein the door engagement zone is a lobe in the cam.

7. The mechanism of claim 4 wherein the door engagement zone is an arcuate array of teeth.

8. The mechanism of claim 1 wherein the rotatable member comprises a sector having an arcuate array of door engagement teeth.

9. The mechanism of claim 8 wherein the rotatable member further includes a member axis of rotation, distances of the teeth from the member axis increasing from one end of the arcuate array to another end of the arcuate array.

10. The mechanism of claim 9 wherein the teeth are slanted toward one angular direction.

11. The mechanism of claim 8 wherein the sector defines at least one aperture to enhance radial compressibility of the sector.

12. A locking mechanism for the door of an ammunition compartment of a military vehicle, the locking mechanism actuated by motion away from the compartment of a blow off panel, the locking mechanism comprising:

a frame member fixed relative to the vehicle and the compartment;

an eccentrically mounted member;

a door engagement zone at a major diameter of the eccentrically mounted member;

means for mounting the eccentrically mounted member rotatably to the frame member, the mounting means including an axis pin on the frame member, the axis pin having a longitudinal axis about which the eccentrically mounted member rotates;

a linkage rod connected to the blow off panel;

a shear pin pivotally connecting the rod to the eccentrically mounted member;

the eccentrically mounted member rotatable by the rod in a first angular direction from a first rotational position where the eccentrically mounted member is clear of the door to a second rotational position where the eccentrically mounted member contacts the door;

means for preventing the eccentrically mounted member from rotating in the first angular direction past the second rotational position;

the strength of the shear pin being low enough to allow breakage by force on the eccentrically mounted member from the preventing means.

13. The mechanism of claim 2 wherein:

the pivotable member is an eccentrically mounted member;

the mounting means comprises an axis pin on the frame member, the eccentrically mounted member rotatable on the axis pin;

the linkage means comprises a rigid linkage member, wherein a portion of the linkage member faces toward the axis pin;

the linkage member has a first position in which the portion is removed from the axis pin;

the linkage member has a second position in which the portion contacts the axis pin.

14. The mechanism of claim 13 wherein the linkage member is in the second position when the door engagement zone contacts the door.

15. The mechanism of claim 14 including a shear pin connecting the eccentrically mounted member to the linkage member, the shear pin breaking after the door engagement zone contacts the door.

* * * * *